US006533336B2

(12) United States Patent
Kemp et al.

(10) Patent No.: US 6,533,336 B2
(45) Date of Patent: Mar. 18, 2003

(54) TRIM ATTACHMENT AND METHOD FOR KNOBS/LEVERS

(75) Inventors: Vincent Michael Kemp, Colorado Springs, CO (US); Domitillia L. Skeels (nee Mora), Colorado Springs, CO (US); Ronald G. Stone, Colorado Springs, CO (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 09/766,018

(22) Filed: Jan. 19, 2001

(65) Prior Publication Data

US 2001/0026071 A1 Oct. 4, 2001

Related U.S. Application Data

(60) Provisional application No. 60/177,000, filed on Jan. 19, 2000.

(51) Int. Cl.[7] ..... E05B 3/00

(52) U.S. Cl. ..... 292/348; 292/352; 16/441

(58) Field of Search ..... 292/348–49, 352–55, 292/DIG. 53; 403/315–17, 327, DIG. 7; 16/412–14, 441; 74/553, 566, 557, 558, 588.5, 528

(56) References Cited

U.S. PATENT DOCUMENTS 524,861 A * 8/1894 Newington ..... 292/348
1,621,174 A * 3/1927 Schlage ..... 292/348
4,132,129 A * 1/1979 Pratt ..... 16/441
4,453,753 A * 6/1984 Fayerman et al. ..... 292/169
4,593,430 A * 6/1986 Spangler et al. ..... 16/422
4,604,879 A * 8/1986 Neary et al. ..... 292/348
4,746,155 A * 5/1988 Hart ..... 16/DIG. 24
5,125,696 A * 6/1992 Robida et al. ..... 292/169.16
5,148,718 A * 9/1992 Kakuguchi et al. ..... 403/383
5,337,450 A * 8/1994 Martin ..... 16/422
5,409,278 A * 4/1995 Harcourt ..... 292/348
5,688,005 A * 11/1997 Ellis ..... 292/348
5,695,169 A * 12/1997 Higgins et al. ..... 16/441
5,749,612 A * 5/1998 Meck et al. ..... 292/347
6,231,092 B1 * 5/2001 Shields etal. ..... 292/347

* cited by examiner

*Primary Examiner*—J. J. Swann
*Assistant Examiner*—Dinesh N Melwani
(74) *Attorney, Agent, or Firm*—Michael Best & Friedrich LLP

(57) ABSTRACT

A trim attachment and method comprises a door lever/knob which is assembled to a spindle housing of a lock assembly by sliding the door lever/knob over the spindle. A retaining mechanism within the door lever/knob automatically engages the spindle to couple the door lever/knob to the spindle when the door lever/knob is properly positioned on the spindle. The spindle and door lever/knob have mating exterior and interior ribs providing torque transfer between the spindle and door lever/knob. An aperture is provided in the door lever/knob to depress a portion of the retaining mechanism to release the retaining mechanism, allowing the door lever/knob to be removed. The improved knob/lever trim attachment and methods provide an easily assembled and manufactured, aesthetically pleasing, and easily replaceable assembly for a door lock assembly.

15 Claims, 3 Drawing Sheets

TRIM ATTACHMENT AND METHOD FOR KNOBS/LEVERS

This application claims the benefit of U.S. Provisional Application No. 60/177,000 filed Jan. 19, 2000, herein incorporated by reference.

TECHNICAL FIELD

This invention relates generally to door knob/lever assemblies, and more particularly to improved knob/lever trim attachment and methods to provide an easily assembled and manufactured, aesthetically pleasing, and easily replaceable assembly.

BACKGROUND OF THE INVENTION

In the art of door handle knob/lever assemblies, a hollow shaft is rotatably mounted within a door preparation in the well-known fashion by a housing attached to the door by screw fasteners. A door handle, and typically, a doorknob or lever, is mounted on the shaft by any of several mounting techniques. One or more set screws are used to secure the doorknob to the shaft. Problems with this technique include that the screw head is typically visible creating an aesthetically unpleasing surface. Special tools, such as an Allen wrench, may also be required to install and remove the doorknob. During operational life of the knob the screw can become loose, thus resulting in wobble, preventing proper operation of the door handle, or causing the handle to fall off when grasped by the user.

Another mechanical mounting technique stakes material in the reduced neck of the knob into openings formed in the shaft. This also axially locks the doorknob to the shaft while enabling the shaft to rotate when rotating the doorknob. However, this method is more of a permanent attachment technique and generally requires special knowledge and tools for removal.

In another mounting technique, the doorknob has a cylindrical, reduced neck portion which is slidably received over the shaft. The shaft has a radially projecting pin which is spring biased outwardly beyond the outer surface of the shaft. The pin is retracted by pressing it inwardly. The shaft receives the cylindrical portion of the door knob thereover, the cylindrical portion having an aperture formed therein which is sized to receive the pin of the shaft therethrough. The arrangement is such that by pressing the pin inwardly to its retracted position, sliding the cylindrical portion of the door knob over the pin, and aligning the aperture with the pin, the pin can extend through the aperture for axially and rotatably locking the door knob to the shaft. The pin method, however, generally requires that the complete handle assembly be disassembled in order to retract the pin and remove the knob. In addition, the pin method provides a relatively poor bearing support which generally allows a certain amount of rotational play and can also result in wobble.

Once secured to the shaft, the doorknob and shaft are rotatably mounted within an opening formed in the housing. In typical door assembly constructions there is a certain amount of wobble between the doorknob and shaft and the housing. This wobble is attributable to tolerances between the shaft and the opening of the housing, and the axial space between the housing and the doorknob.

From the foregoing, the limitations of known trim attachment methods include possible accidental or eventual pull of the trim (lever/knob) by the user which could cause injury. Any wobble or looseness of the trim also suggests inferior quality. Further, if replacement of the trim is desired, the user is faced with a difficult task requiring special knowledge of the construction, or the user must have special tools therefore. Typical trim attachments also degrade from the appearance of the trim or require removal of the lock from the door. Other disadvantages are also apparent in known attachment methods and trim assemblies.

The foregoing illustrates limitations known to exist in present handle/door knob designs. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is an object of the present invention to provide an improved knob/lever trim attachment and method to allow easy assembly and manufacture, and to provide an aesthetically pleasing, and easily replaceable trim assembly. It is a further object of the present invention to provide an improved knob/lever trim attachment and method which prevents wobble between the knob/lever trim and the doorknob shaft, as well as improving resistance to torque upon rotation thereof.

In one aspect of the present invention, this is accomplished by providing a door handle/knob assembly comprising a spindle housing having a first end and a second end, wherein the first end comprises a spindle and the second end comprises a mechanism for engagement to a door lock assembly. The door lever/knob assembly further comprises a door knob having a handle portion and a neck portion, wherein the neck portion comprises a recess and a housing for a mechanism to retain the door knob on the spindle, and a mechanism for preventing relative rotation of the handle portion in relation to the spindle portion. In another aspect of the present invention, there is provided a method of attaching a door lever/knob to a door lock assembly comprising the steps of aligning a recess of the neck portion of the door lever/knob with a spindle portion of the door lock assembly, sliding the recess over the spindle portion, and automatically engaging a mechanism for retaining the door knob on the spindle. A method or detaching a door lever/knob from a door lock assembly is also provided.

DETAILED DESCRIPTION

Figure 1:
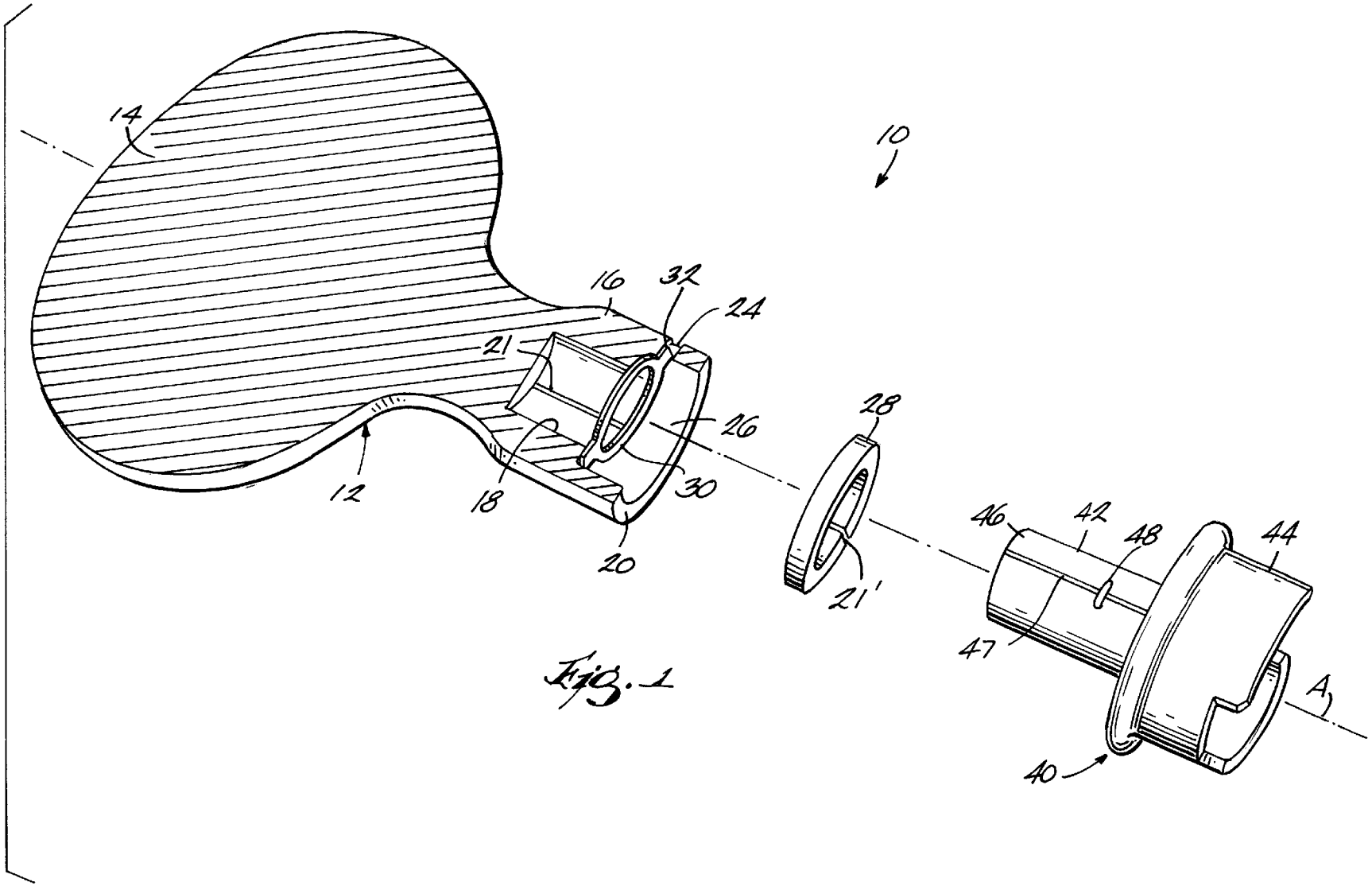
FIG. 1 is an exploded perspective view of the door handle knob/lever trim assembly of the present invention showing the knob/lever trim in a cross-section to reveal the interior recess and associated parts thereof.
Figure 2A:
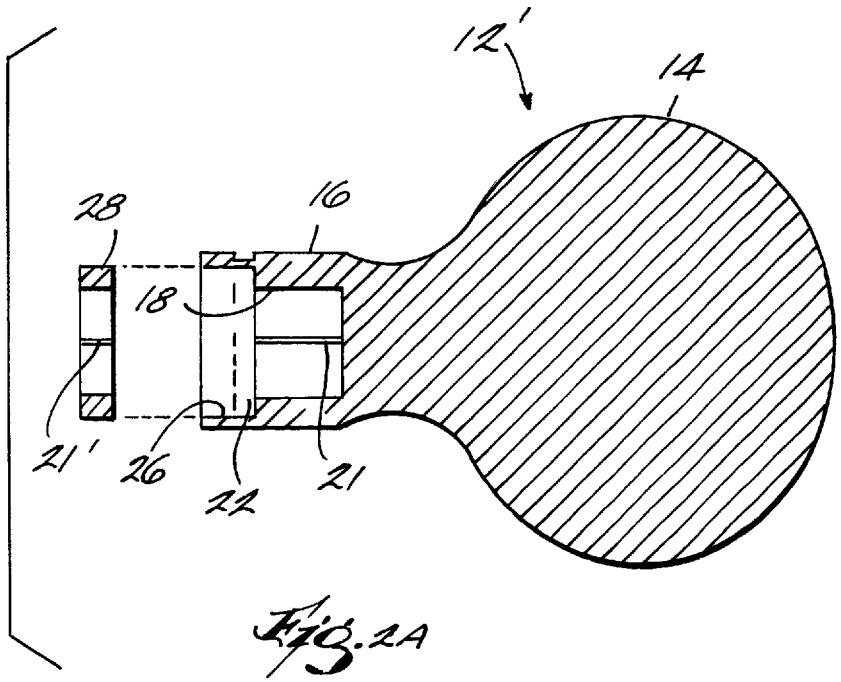
FIG. 2A is a cross-sectional view of the door handle knob/lever trim in accordance with the present invention of FIG. 1.

Referring now to the drawings, wherein similar reference characters designate corresponding parts throughout the several views, there is generally indicated at 10 a door knob/lever trim assembly of the present invention. As shown in FIG. 1, the door knob/lever trim assembly 10 comprises a knob/lever trim 12 of the type generally used as a door handle. Other styles of knob/lever trim 12 may be provided if desired, generally comprising a knob or lever which is grasped by the user and rotated for operation of the door latch mechanism. A retainer clip 30 is provided in association with the trim 12, and a spindle housing 40 which is part of a lock chassis (not shown) is attached to trim 12. The knob/lever trim 12 comprises a handle portion 14 shown herein as a standard doorknob, which narrows down into a neck portion 16. The neck portion 16 of the knob/lever trim 12 includes a first recess 18 formed in a bottom surface 20 of the neck portion. The first recess 18 is formed generally coaxial to the longitudinal axis A of the neck portion 16. At least one slot, or internal rib 21 is formed into the surface of the first recess 18 such that it is parallel to longitudinal axis A. A second recess 26, is also formed coaxial to the longitudinal axis A and having a larger diameter than the first recess 18. As best shown in FIG. 2A, the second recess 26, has a shallower depth than that of the first recess 18 such that a ledge is formed between the diameter of the second recess 26 and the diameter of the first recess 18 at the bottom of the second recess 26. A slot 22 is then formed by inserting a washer-shaped insert 28 into the second recess 26. The washer shaped insert 28 has an interior diameter corresponding to the diameter of the first recess 18. The outer diameter of the washer shaped insert 28 generally corresponds to the diameter of the second recess 26. The slot 22 is formed by ensuring that a gap exists between the insert 28 and the ledge formed at the bottom of the second recess 26. The insert 28 is secured to the second recess 26 by an interference fit, welded into place, or any other appropriate fastening mechanism. The insert 28 also includes at least one slot, or interior rib 21' generally corresponding to the at least one interior rib 21 on the surface of the first recess 18. In a preferred form, a plurality of ribs 21, 21' are provided for orientation and additional strength in the assembly as will be seen. The insert 28 is secured to the second recess 26 while ensuring that the interior ribs 21 and 21' are properly aligned. Using insert 28, the retaining clip 30 is inserted against the ledge formed at the bottom of the second recess 26 and then constrained in location within a plane normal to axis A within the slot 22 created by the addition of insert 28 as will be described in greater detail below.

Figure 2B:
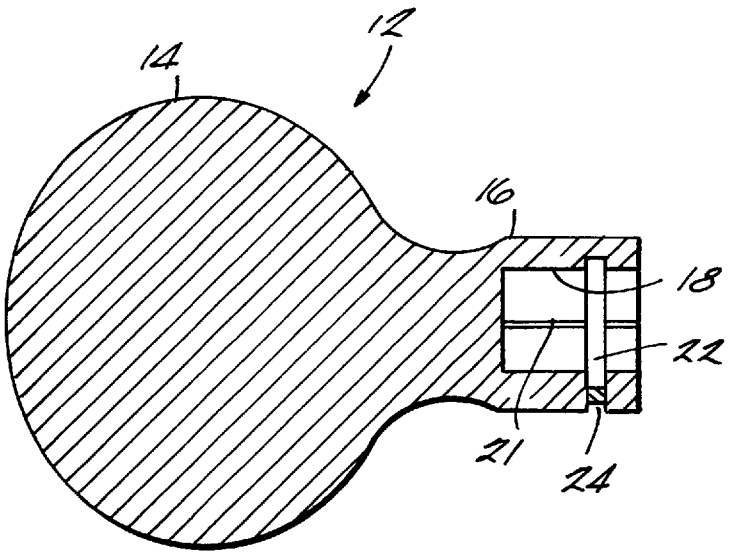
FIG. 2B is a cross-sectional view of the door handle knob/lever trim in an alternate embodiment of the present invention.

An alternate embodiment is shown in FIG. 2B, wherein the first recess 18 includes a slot 22 formed generally radially perpendicular to the longitudinal axis A along an interior surface 24 of the recess 18. The slot 22 is machined into the interior diameter surface of the first recess 18. This embodiment requires that retainer clip 30 is able to be deformed for passage through the first recess 18 and then inserted into the slot 22.

The retainer clip 30 is housed within the slot 22. The retainer clip 30 is generally formed as a retaining ring or snap ring, and has a thickness generally corresponding to the width of the slot 22 such that there is no play, preventing axial movement of the retainer clip 30 within the slot 22. This will provide a more secure fastening of the door handle knob/lever trim 12 on the spindle housing 20. The retainer clip 30 is accessible through a clip access slot 24, which is an aperture through the wall of the neck 16. By depression of the retainer clip end 32, the retainer clip 30 is at least partially expand radially within the slot 22.

Spindle housing 40 comprises a first end 42 and a second end 44. The first end 42 is a spindle having a generally cylindrical body. The second end 44 comprises a door lock assembly engagement portion. The spindle 42 has a leading end 46 which comprises a chamfer or radius. The spindle 42 also has at least one external rib 47 on the surface thereof matingly corresponding to the at least one internal rib 21 of the door handle/knob trim 12 and at least one internal rib 21' provided on insert 28.

The retainer clip 30 has an outside diameter which is slightly smaller than the diameter of the slot 22. This allows the retainer clip 30 to expand when engaged by the leading end 46 of the spindle 42 as will be discussed in detail below.

The method of attaching the door handle/knob trim 12 to the spindle housing 40 to form a door lock assembly 10, first requires that the first recess 18 is aligned with the spindle portion 42 of the spindle housing 40 such that the internal ribs 21, 21', in the knob/lever trim 12 are aligned with the external ribs 47 on the spindle. The door handle/knob trim 12 is moved such that the recess 18 slides over the spindle portion 42. The internal ribs 21, 21' in the knob lever trim 12 matingly engage the external ribs 47 on the spindle 42. As the leading edge 46 of the spindle 42 engages the retainer clip 30 housed in slot 22, the radiused edge 46 of the spindle forces the retainer clip 30 to open and allow the door handle/knob trim 12 to continue to slide over the spindle portion until the retaining clip engages the spindle slot 48. When the trim is properly installed, the retainer clip 30 will make an audible sound indicating the knob/lever trim 12 is securely locked in place. The spindle slot 48 allows a portion of the retainer clip 30 to engage the spindle 42. This engagement prevents further axial movement both toward the spindle housing 40 and away from the spindle housing. The engagement of the external ribs 47 on the spindle 42 with the internal ribs 21, 21' of the door handle/knob trim 12 prevents relative rotation between the spindle housing 40 and the door handle/knob trim 12. The door handle/knob trim 12 is thus securely fastened to the spindle housing 40 in a manner preventing both axial and radial movement with respect to the spindle housing without wobble or play.

The method of detaching the door handle/knob from a door lock assembly comprising the steps of depressing retainer clip end 32 causing retainer clip 30 to expand and dislodge from the spindle slot 48. The door handle/knob trim 12 may then be slid away from the spindle housing 40 until said door handle/knob trim is completely disengaged from the spindle 42. Depressing retainer clip end 32 causes the retainer clip 30 to expand radially within slot 22 such that the retainer clip 30 disengages retainer slot 48 on the spindle 42, thus allowing axial movement of the door handle/knob trim 12. The removal is accomplished without the need of specialized tools or specialized knowledge. Accordingly, any wire form, such as a paper clip, nail, ball point pen, coat hangar end, or the like, can be inserted through clip access slot 24 in the door handle/knob trim 12 to depress the retaining clip end 32. The retainer clip access slot 24 is preferably large enough to provide access to the retainer clip end 32 by any suitable wire form tool to cause disengagement of the retainer clip 30 from spindle slot 48. Once the door handle/knob trim 12 is removed, a new door handle/knob trim can be attached to the spindle housing 40. This is especially useful when redecorating a room, easily replacing the door handle/knob trim with one of a different color, finish, or ornamental design can quickly and easily enhance the aesthetic appearance of a door and/or room.

Figure 3:
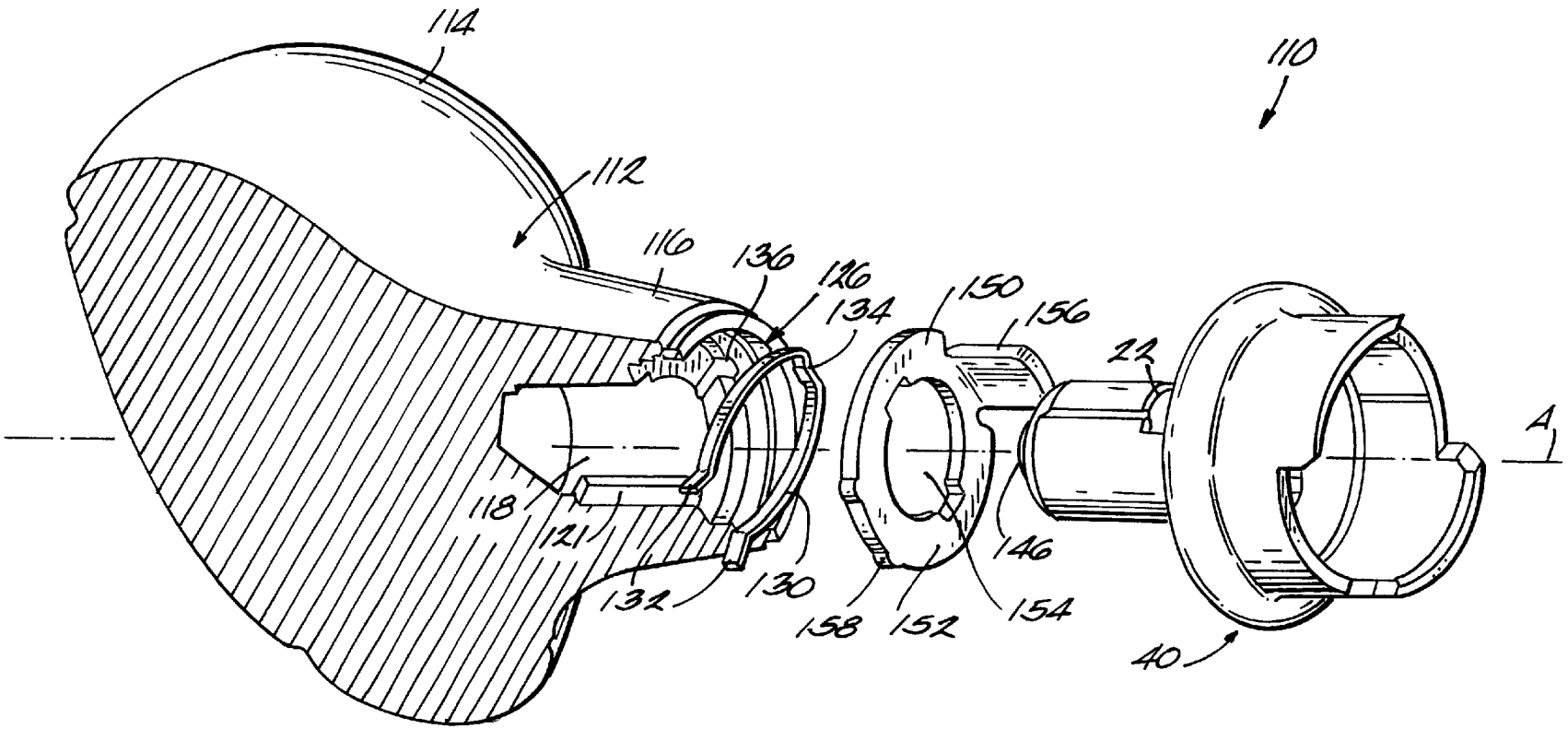
FIG. 3 is an exploded perspective view of an alternate embodiment of the door handle knob/lever trim assembly of the present invention showing the knob/lever trim in a cross-section to reveal the interior recess and associated parts thereof.

Referring now to FIG. 3, an alternate embodiment of the present invention is shown. Door knob/lever trim assembly 110 comprises a knob/lever trim 112. A retainer clip 130 is provided in association with the trim 112, and spindle housing 40 which is part of a lock chassis (not shown) is attached to trim 112. In addition, a torque ring component 150 is provided to help transfer rotational forces between spindle 40 and trim 112 as well as hold retainer clip 130 in its proper axial position. The knob/lever trim 112 comprises a handle portion 114 shown herein as a standard doorknob, which narrows down into a neck portion 116. The neck portion 116 of the knob/lever trim 112 includes a first recess 118 formed generally coaxial to the longitudinal axis A of the neck portion 116. At least one slot, or internal rib 121 is formed into the surface of the first recess 118 such that it is parallel to longitudinal axis A similar to that of knob/lever trim 12 of the previous embodiment. A second recess section 126 positioned toward the end of neck portion 116 having varying diameters each having a larger diameter than the first recess 118.

Retainer clip 130 is similar in operation to retainer clip 30 of the previous embodiment. The retainer clip 130 has an ovalized outside diameter which is slightly smaller than the diameter of the slot 22. This allows the retainer clip 30 to expand when engaged by the leading end 46 of the spindle 40. Retainer clip 130 engages slot 22 of spindle 40 in the same manner as discussed in the previous embodiment. Retainer clip 130 has two ends 132 opposite a disengagement portion 134 generally at the mid point between ends 132. Disengagement portion 134 is positioned radially directly below an access aperture 136. An object inserted into access aperture 136 depresses disengagement portion 134, deforming retainer clip 130 and disengaging retainer clip 130 from slot 22 of spindle 40.

Torque ring component 150 comprises a generally washer shaped body portion 152 having a central aperture 154 correspondingly shaped to matingly engage spindle 40 in a co-rotating manner. Torque ring component 150 also comprises an arm extension portion or tang 156 extending parallel to axis A and engaging an aperture (not shown) in the spindle 40. Tang 156 provides additional strength and an additional torque transfer path for rotational forces between knob/lever trim 112 and spindle 40. The washer shaped body portion 152 of torque ring component 150 may also include one or more small tabs 158 extending radially outward from an outside diameter of washer shaped body portion 152. These small tabs 158 engage corresponding recesses (not shown) in neck portion 116 which also provides an additional torque transfer path for rotational forces between knob/lever trim 112 and spindle 40.

The present invention provides a knob/lever trim attachment assembly which prevents accidental or eventual pull of the trim attachment from the spindle housing 40. The installation and replacement of the trim 12 is greatly simplified, and does not require any special tooling or knowledge of the assembly construction. The attachment minimizes wobble or looseness by provision of a significant bearing surface therebetween, while allowing for a small shank diameter if desired for design aesthetics. The attachment provides an aesthetically pleasing construction which doesn't require screws, set screws or other unsightly attachment means, with the attachment being effectively concealed. The attachment is constructed such that the integrity of the knob/lever finish is not compromised, either during manufacture or installation/replacement. Manufacture of the attachment is simplified and cost effective, and installation is simplified by ensuring proper orientation between components. The strength and durability of the attachment is enhanced and the resistance to torque enhanced due to the cross section configuration of the spindle 40 and mating recess in the knob/lever shank 16.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A door handle assembly comprising:

a spindle housing having a first end and a second end, said first end comprising a spindle and said second end comprising a door lock assembly engagement portion;

a door handle having a handle portion and a neck portion, said neck portion comprising a recess having a first slot along an interior diameter thereof; and a retainer clip extending circumferentially around a substantial portion of said spindle and housed within said first slot, said retainer clip engaging a second slot in said spindle to attach said door handle to said spindle housing, wherein at least one anti-rotation recess is disposed on one of said spindle portion and said recess of said neck portion, and at least one mating anti-rotation projection, is disposed in the other of said spindle portion and said recess of said neck portion, preventing relative rotation between said door handle and said spindle housing, wherein said first slot is formed by inserting a washer-shaped insert into a second recess of said neck, said second recess having a diameter larger than said first recess, wherein said insert has an interior diameter corresponding to said first recess and an exterior diameter corresponding to said diameter of said second recess.

2. The door handle assembly as recited in claim 1, wherein said insert further comprises an anti-rotation projection or anti-rotation recess.

3. The door handle assembly as recited in claim 1, wherein said neck portion includes an access slot through a wall of said neck portion which enables access to said retainer clip; wherein said retainer clip can be depressed in a manner disengaging said retainer clip from said slot in said spindle and allowing said door handle to be disengaged from said spindle.

4. A door handle assembly comprising:

a handle having a handle portion and a neck portion, said neck portion including a first recess having a first diameter and a second recess having a second diameter, said second recess having an interior surface, said second diameter being larger than said first diameter;

an insert housed in said second recess of said neck portion, said insert including a central aperture having an interior diameter corresponding to said first diameter and an exterior diameter corresponding to said second diameter, said interior surface and said insert forming a first slot in said neck;

a spindle housing having a first end and a second end, said first end having a spindle and said second end having a door lock assembly engagement portion, said spindle defining a second slot; and a retainer clip extending circumferentially around a substantial portion of said spindle, said retainer clip being housed within said first slot and engaging said second slot, thereby coupling said door handle and said spindle housing.

5. The door handle assembly of claim 4, wherein said insert engages said second recess, and wherein said insert cooperates with said neck portion to maintain said retaining clip in said first slot.

6. The door handle assembly of claim 4, wherein said insert frictionally engages said neck portion maintaining said retainer clip in said first slot.

7. The door handle assembly of claim 4, wherein at least one anti-rotation recess is disposed in one of said spindle and said first recess of said neck portion, and wherein at least one mating anti-rotation projection is disposed on the other of said spindle and said first recess of said neck portion, preventing relative rotation between said spindle and said neck portion.

8. The door handle assembly of claim 4, wherein at least one anti-rotation recess is disposed in one of said insert and said spindle and, wherein at least one mating anti-rotation projection is disposed on the other of said insert and said spindle, preventing relative rotation between said spindle and said insert.

9. The door handle assembly of claim 4, wherein said insert defines a first anti-rotation recess, said first recess of said neck portion defines a second anti-rotation recess, said spindle includes an anti-rotation projection matingly engaging said first anti-rotation recess and said second anti-rotation recess and preventing relative rotation between said spindle, said neck portion, and insert.

10. The door handle assembly of claim 4, wherein said insert includes a first anti-rotation projection, said first recess of said neck portion includes a second anti-rotation projection, said spindle defines an anti-rotation recess, and wherein said first anti-rotation projection and said second anti-rotation projection matingly engaging said anti-rotation recess preventing relative rotation between said spindle, said neck portion, and insert.

11. The door handle assembly of claim 4, wherein said neck includes an outer surface and an access slot extending through said outer surface and communicating with said first slot.

12. The door handle assembly of claim 11, wherein said access slot provides access to said retainer clip, and wherein said retainer clip can be depressed in a manner disengaging said retainer clip from said second slot in said spindle, allowing said door handle to be disengaged from said spindle.

13. The door handle assembly of claim 4, wherein said spindle defines an axis, and wherein an arm extends axially from said insert.

14. The door handle assembly of claim 13, wherein said spindle defines an axially extending aperture, and wherein said arm matingly engages said axially extending aperture.

15. The door handle assembly of claim 4, wherein at least one radially extending tab is disposed on one of said insert and said first slot of said neck portion, and the other of said insert and said first slot of said first neck portion defines at least one anti-rotation aperture, and wherein said at least one radially extending tab matingly engages said at least one anti-rotation aperture, preventing rotation of said insert relative to said neck portion.

* * * * *